US010946424B2

(12) United States Patent
Hedvall et al.

(10) Patent No.: US 10,946,424 B2
(45) **Date of Patent: *Mar. 16, 2021**

(54) COLD PILGER ROLLING MILL AND METHOD FOR PRODUCING A PIPE

(71) Applicant: Sandvik Materials Technology Deutschland GmbH, Düsseldorf (DE)

(72) Inventors: Christofer Hedvall, Bielefeld (DE); Udo Rauffmann, Werther (DE); Thomas Froböse, Versmold (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 260 days.

This patent is subject to a terminal disclaimer.

(21) Appl. No.: 16/089,419

(22) PCT Filed: Mar. 28, 2017

(86) PCT No.: PCT/EP2017/057307

§ 371 (c)(1),
(2) Date: Jan. 24, 2019

(87) PCT Pub. No.: WO2017/167745

PCT Pub. Date: Oct. 5, 2017

(65) Prior Publication Data

US 2019/0160501 A1 May 30, 2019

(30) Foreign Application Priority Data

Apr. 1, 2016 (DE) ..... 10 2016 106 034.8

(51) Int. Cl.
*B21B 21/04* (2006.01)
*B21B 25/02* (2006.01)

(52) U.S. Cl.
CPC ..... *B21B 21/045* (2013.01); *B21B 25/02* (2013.01)

(58) Field of Classification Search
CPC ..... B21B 21/00; B21B 21/005; B21B 21/02; B21B 21/04; B21B 21/045; B21B 21/06;
(Continued)

(56) References Cited

U.S. PATENT DOCUMENTS 4,203,309 A 5/1980 Ermakov et al.
5,916,320 A * 6/1999 Stinnertz ..... B21B 21/005 72/208

(Continued)

FOREIGN PATENT DOCUMENTS

DE 2922941 A1 * 12/1980 ..... B21B 21/045
DE 43 42 858 A1 6/1995

(Continued)

OTHER PUBLICATIONS

International Search Report and Written Opinion dated Jun. 7, 2017 issued in corresponding International Patent Application No. PCT/EP2017/057307.

(Continued)

*Primary Examiner* — Teresa M Ekiert
*Assistant Examiner* — Sarkis A Aktavoukian
(74) *Attorney, Agent, or Firm* — Morgan, Lewis & Bockius LLP

(57) ABSTRACT

A cold pilger rolling mill including a front mandrel thrust block that has a distance of at least 30 m from a feed chuck, measured with the feed clamping carriage at the rear reversal point thereof. The distance is measured between the rear (in the feed direction of the hollow) end of the chuck of the front mandrel thrust block and the front (in the feed direction of the hollow) end of the feed chuck of the feed clamping carriage at the rear reversal point thereof.

16 Claims, 3 Drawing Sheets

(58) Field of Classification Search
CPC ..... B21B 21/065; B21B 25/02; B21B 25/00; B21B 17/02; B21B 17/04; B21B 17/08; B21C 47/16; B21C 47/18; B21C 47/22
See application file for complete search history.

(56) References Cited

U.S. PATENT DOCUMENTS

| | | | | |
|---|---|---|---|---|
| 6,360,575 | B1 * | 3/2002 | Zavodchikov | B21B 21/02 72/208 |
| 9,120,135 | B2 | 9/2015 | Froböse | |
| 9,233,406 | B2 | 1/2016 | Froböse et al. | |
| 10,226,802 | B2 | 3/2019 | Froböse | |
| 2009/0064749 | A1 * | 3/2009 | Hidaka | C22C 38/58 72/208 |
| 2012/0125066 | A1 | 5/2012 | Froböse | |
| 2012/0139195 | A1 * | 6/2012 | Frobose | B23B 13/125 279/123 |
| 2012/0272706 | A1 * | 11/2012 | Frobose | B21C 47/04 72/206 |
| 2015/0258590 | A1 | 9/2015 | Rauffmann et al. | |

FOREIGN PATENT DOCUMENTS

| | | | | | |
|---|---|---|---|---|---|
| DE | 10 2009 045 640 | A1 | | 4/2011 | |
| DE | 1020121086 | A1 | * | 3/2014 | B21B 21/00 |
| EP | 0 079 295 | A1 | | 5/1983 | |
| JP | S56-075554 | A | | 6/1981 | |
| JP | S58-0903003 | A | | 5/1983 | |
| JP | S58-156283 | A | | 9/1983 | |
| JP | S62-130704 | A | | 6/1987 | |
| JP | H04197525 | A | * | 7/1992 | |
| JP | H07-185608 | A | | 7/1995 | |
| JP | 2015-532891 | A | | 11/2015 | |
| JP | 2016-531757 | A | | 10/2016 | |
| WO | 2010-130614 | A1 | | 11/2010 | |

OTHER PUBLICATIONS

Goto et al., "Assessment of the Strength and the Toughness of Tool Materials for Metal Forming". University of Fukui School of Engineering Research Report. vol. 38, No. 1, Mar. 1990, pp. 1-8. (with partial translation).
Office Action dated Dec. 15, 2020, issued in corresponding Japanese Patent Application No. 2018-551094.

* cited by examiner

COLD PILGER ROLLING MILL AND METHOD FOR PRODUCING A PIPE

The present invention relates to a cold pilger rolling mill for cold working a hollow into a strain-hardened tube with a rolling stand with rollers rotatably mounted thereon, wherein the roll stand in a direction parallel to a longitudinal axis of the hollow is movable back and forth between a front reversal point in an feed direction of the hollow and a rear reversal point in an feed direction of the hollow, wherein the roll stand is driven by a motor, wherein the rollers during a reciprocating motion of the hollow carry out a rotational motion, so that the rollers in an operation of the cold pilger rolling mill roll the hollow over a mandrel into a tube, a mandrel, wherein the mandrel when considered in the feed direction of the hollow is supported at a rear end of a mandrel bar such that in an operation of the cold pilger rolling mill, the hollow is rolled by the rollers over the mandrel, at least one feed clamping carriage with a feed chuck mounted thereon to receive the hollow, wherein the feed-clamping carriage is movable back and forth in a direction parallel to the longitudinal axis of the hollow between a front reversal point in the feed direction of the hollow and rear reversal point in the feed direction of the hollow so that the hollow in an operation of the cold pilger rolling mill experiences a stepwise feed in a direction towards the mandrel, wherein the feed chuck is openable and closeable in a radial direction such the feed chuck releases or clamps the hollow, and at least one mandrel thrust block with a chuck for holding the mandrel bar, wherein a front mandrel thrust block is positioned in front of the feed clamping carriage in the feed direction of the hollow such that in an operation of the cold pilger rolling mill the mandrel bar is fixable by the chuck of the front mandrel thrust block, wherein the chuck of the front mandrel thrust block is openable in a radial direction, so that a hollow is feedable between the chuck and the mandrel bar.

In addition, the present invention relates to a method for manufacturing a tube by cold working a hollow in a cold pilger rolling mill having a roll stand with rollers rotatably mounted thereon, a mandrel supported by a mandrel bar, at least one mandrel thrust block holding the mandrel bar, and at least one feed clamping carriage having a feed chuck to receive the hollow comprising the steps of:

a) opening in a radial direction a chuck of a front mandrel thrust block in the feed direction of the hollow and feeding a first hollow through the front mandrel thrust block,
b) feeding the first hollow to the feed clamping carriage and receiving the first hollow by opening the feed chuck in the radial direction and clamping the first hollow by closing the feed chuck in the radial direction at a front reversal point if the feed clamping carriage when considered in the feed direction of the hollow,
c) after completely feeding the first hollow through the front mandrel thrust block closing the chuck of the front mandrel thrust block in the radial direction such that the front mandrel thrust block holds the mandrel bar supporting the mandrel,
d) rolling the first hollow by the rollers over the mandrel into a strain-hardened tube by stepwise feeding the first hollow by means of the feed clamping carriage and oscillating the roll stand with the rollers back and forth between a front and a rear reversal point.

For the manufacturing of precise metal tubes, in particular of steel, an extended hollow cylindrical blank is typically cold reduced in the entirely cooled state by compressive stresses. In this case, the blank is worked into a tube with a defined reduced outer diameter and a defined wall thickness.

The most common tube reduction method is known as cold pilgering, wherein the blank is denoted as a hollow. The hollow during rolling is pushed over a calibrated mandrel comprising the inner diameter of the finished tube while the hollow spanned from the outside by two calibrated rollers defining the outer diameter of the finished tube and is rolled in the longitudinal direction over the mandrel.

During cold pilgering, the hollow is stepwise fed towards and over the mandrel while the rollers are reciprocated horizontally over the mandrel and thus over the hollow. In this case, the horizontal motion of the rollers is determined by a roll stand, wherein the rollers are rotatably mounted on the roll stand. In known pilger rolling mills the roll stand is reciprocated by means of a crank mechanism in a direction parallel to the mandrel, while the rollers receive a rotational motion by gear rack being fix with respect to the roll stand, wherein gear wheels fixedly mounted on the roller axis engage the gear rack.

The feeding of the hollow over the mandrel is carried out by means of a feed clamping carriage, enabling a translational motion in a direction parallel to the axis of the mandrel.

At the beginning of the rolling process, the hollow is pushed by a loading driver with rollers into the chuck of the feed clamping carriage. At the front reversal point of the roll stand in the feed direction of the hollow, i.e. at the infeed dead center ET of the roll stand, the rollers reach a position in which the hollow can be received in the so-called feed pockets of the rollers and between the rollers. The conically calibrated rollers arranged one above the other in the rolling mill roll over the hollow by rolling back and forth on the hollow in the feed direction of the feed clamping carriage. In this case, during a rolling stroke the pair of rollers moves by a distance L from the infeed dead center ET to the rear reversal point of the roll stand in the feed direction of the hollow, i.e. to the discharge dead center AT of the rolling mill, and extends the hollow over the mandrel held inside the hollow. The rollers and the mandrel are calibrated so that the gap between the roller and the mandrel in the region of the working caliber of the rollers steadily decreases from the wall thickness of the hollow to the wall thickness of the finished rolled tube. In the adjoining region of the smoothing caliber of the rollers no reduction of the wall thickness of the tube to be manufactured takes place any more but only a smoothing of the surface of the tube to be manufactured. When arrived at the discharge dead center, the finished rolled tube is released by the discharge pockets of the rollers.

A feed of the hollow between the rollers takes place either only at the front reversal point or both at the front and at the rear reversal point of the roll stand. By repeatedly rolling each tube section, i.e. by feed steps which are significantly smaller than the path of travel of the roll stand between the front and the rear reversal point, a uniform wall thickness and roundness of the tube, a high surface quality of the tube and an uniform inner and outer diameter can be achieved.

In order to obtain a uniform shape of the finished tube, the hollow experiences an intermittent rotation about its axis in addition to a stepwise feed when reaching the front reversal point of the roll stand. The rotation of the hollow takes place at both reversal points of the roll stand, i.e. both at the infeed dead center and at the release dead center.

In the prior art cold pilger rolling mills are known, which can handle hollows with a length of up to about 15 m. However, if high quality tubes, i.e. with a uniform wall thickness and a high surface quality of the inner and outer surface, are required with a length of beyond 150 m, such tubes cannot be manufactured in a cold pilger rolling mill according to the prior art. Manufacturing of one-piece tubes with a length of more than 150 meters in a cold pilger rolling mill requires cold working of hollows whose length significantly exceeds the length of hollows that can be rolled with conventional equipment.

Compared to the prior art, it is therefore an object of the present invention to provide an apparatus and a method which enable cold rolling of hollows having a length of 30 m or more. Another object of the present invention relates to a space-saving machining of hollows having a length of 30 m or more, such that long tubes of high quality can be manufactured in a cold pilger rolling mill avoiding high costs due to the necessity of large workshops. Another object of the present invention is to roll long hollows as efficiently as possible without reducing the quality of the tubes to be manufactured.

At least one of these objects is solved by a cold pilger rolling mill for cold working a hollow into a strain-hardened tube having a roll stand with rollers rotatably mounted thereon, the roll stand being movable back and forth in a direction parallel to a longitudinal axis of the hollow between a front reversal point in a feed direction of the hollow and a rear reversal point in the feed direction of the hollow, wherein the roll stand is driven by a motor, wherein the rollers during a reciprocating motion of the hollow experience a rotational motion, so that the rollers in an operation of the cold pilger rolling mill roll the hollow into a tube, a mandrel, wherein the mandrel is supported by a mandrel bar at a rear end of the mandrel bar in the feed direction of the hollow, such that in an operation of the cold pilger rolling mill, the hollow is rolled by the rollers over the mandrel, at least one feed clamping carriage with a feed chuck attached thereto to receive the hollow, wherein the feed clamping carriage is movable back and forth in a direction parallel to the longitudinal axis of the hollow between a front reversal point in the feed direction of the hollow and a rear reversal point in the feed direction of the hollow such that the hollow in an operation of the cold pilger rolling mill experiences a stepwise feed in a direction towards the mandrel, wherein the feed chuck is openable and closeable in a radial direction in such a way that the feed chuck releases or clamps the hollow, and with at least one mandrel thrust block with a chuck to hold the mandrel bar, wherein a front mandrel thrust block in the feed direction of the hollow is arranged in front of the feed clamping carriage such that the mandrel bar in an operation of the cold pilger rolling mill is holdable by the chuck of the front mandrel thrust block, wherein the chuck of the front mandrel thrust block is openable in the radial direction, so that a hollow is feedable between the front mandrel thrust block and the mandrel bar, wherein the front mandrel thrust block comprises a distance of at least 30 m from the feed chuck, measured with the feed clamping carriage at its rear reversal point.

The selected distance of the front mandrel thrust block from the feed chuck allows the processing of hollows with a length of 30 m or more in a cold pilger rolling mill according to the invention. Here, in an embodiment, the distance between the front mandrel thrust block and the feed chuck is measured between the rear end of the chuck of the front mandrel thrust block in the feed direction of the hollow and the front end of the feed chuck of the feed clamping carriage in the feed direction of the hollow, wherein the feed clamping carriage is at its rear reversal point.

The previously defined distance is at least 30 m and allows to arrange a hollow between the front mandrel thrust block and the feed chuck of the feed clamping carriage such that both the chuck of the front mandrel thrust block and the feed chuck of the feed clamping carriage can be closed without clamping or pinching the hollow. Accordingly, the distance between the front mandrel thrust block and the feed chuck approximately describes the length of the hollow, which can be loaded into the cold pilger rolling mill according to the invention and can be rolled with it.

When inserting the hollow into the cold pilger rolling mill, the front mandrel thrust block is opened by opening the chuck of the mandrel thrust block in the radial direction, so that the hollow is feedable between the front mandrel thrust block and the mandrel bar in the direction towards the mandrel. After the hollow has left the front mandrel thrust block, the chuck of the front mandrel thrust block is closed to hold the mandrel bar.

If for the purposes of the present application front and rear positions are mentioned, these positions are from the perspective of a viewer who looks along the hollow in the feed direction of the hollow.

In an embodiment of the present invention, the distance between the front mandrel thrust block and the feed chuck, measured with the feed chuck at its rear reversal point, is at least 40 m and in another embodiment is at least 50 m.

In an embodiment of the present invention, the material of the mandrel bar of the cold pilger rolling mill has a tensile strength of 1000 N/mm$^2$ or more, or of 1500 N/mm$^2$ or more.

In a further embodiment of the present invention, the mandrel bar is a tube having an outer diameter, an inner diameter and a wall thickness.

The tensile strength is a property of a material and describes the maximum mechanical tensile stress which the material withstands before it breaks. The tensile strength is measured based on the maximum achievable tensile force relative to the initial cross-section of the sample to be measured.

The mandrel bar supporting the mandrel during rolling of the hollow must withstand high forces, so that the material of which the mandrel bar is made of must have high load capacity in terms of tensile strength.

Suitable materials for this purpose are, for example, tempered steels according to DIN EN 10083, which by heat-treatment, i.e. hardening and tempering, obtain a high tensile strength and fatigue strength. The carbon content of tempered steels is usually between 0.2% and 0.65%, with different alloy contents of chromium, manganese, molybdenum and nickel mixed in different proportions depending on the intended use. Examples of alloyed tempered steels with a tensile strength of more than 1000 N/mm$^2$ are the steel grades 42 CrMo 4, 34 CrNiMo 6 and 30 CrNiMo 8.

In addition, in an embodiment of the present invention, the mandrel bar has an elongation of 10% or less, and in an embodiment of 5% or less.

The elongation is an indication of the relative change in length of a sample under load, for example by a force or by a change in temperature. Also, a high elasticity of the mandrel bar is required in rolling to prevent the mandrel bar from breaking due to a large elongation. Like for a high tensile strength, tempered steels are also suitable to provide the required elongation. For example, in addition to a tensile strength of 1000 N per mm$^2$, the tempered steel 30 CrNiMo 8 also has an elongation of 10% or less and is thus suitable as a material for the mandrel bar according to the invention.

In a further embodiment of the present invention, the cold pilger rolling mill has two feed clamping carriages, each with a feed chuck attached thereto, and a controller, wherein the controller is arranged to control the motion of the two feed clamping carriages such that the hollow in a continuous operation of the cold pilger rolling mill is alternately clamped by one of the feed chucks and is stepwise fed in the direction towards the mandrel, wherein the front mandrel thrust block comprises a distance from the feed chuck of the rear feed clamping carriage in the feed direction of the hollow of at least 30 m measured with the feed clamping carriage at its rear reversal point.

In this way, a higher, i.e. continuous throughput of hollows through the cold pilger rolling mill is enabled. This makes the rolling process more efficient and less expensive by saving on operating costs. In addition, no feed clamping carriage with a long path of travel is required, but the entire required travel is divided into two subsections, so that each of the two feed clamping carriages only has to cover one of these sections.

In another embodiment of the present invention, the cold pilger rolling mill has a rear mandrel thrust block with a chuck for holding the mandrel bar in the feed direction of the hollow between the front reversal point of the feed clamping carriage and the front mandrel thrust block, wherein the rear mandrel thrust block comprises a distance from the front mandrel thrust block of at least 30 m, in such a way that the mandrel bar during operation of the cold pilger rolling mill is holdable by at least one chuck of the front mandrel thrust block or the rear mandrel thrust block.

In an embodiment, the distance between the front and rear mandrel thrust block is defined as the distance between the rear end of the front mandrel thrust block in the feed direction of the hollow and the front end of the rear mandrel thrust block in the feed direction of the hollow. A hollow having a length with this maximum spacing can therefore be loaded between the front and rear mandrel thrust blocks, while the chucks of the front and the rear mandrel thrust block are closed and hold the mandrel bar, i.e. without pinching the hollow.

The arrangement of a rear mandrel thrust block between the front reversal point of the feed clamping carriage and the front mandrel thrust block in addition to the front mandrel thrust block enables the processing of a plurality of long hollows, i.e. with a length of 30 m or more, in a continuous operation. If a hollow has already completely been passed through the rear mandrel thrust block and has been rolled over the mandrel, the rear mandrel thrust block is closed to support the mandrel bar. Now, the front mandrel thrust block no longer needs to hold the mandrel bar and can be opened in contrast to the rear mandrel thrust block, so that another hollow can be fed into the cold pilger rolling mill.

In an embodiment, the cold pilger rolling mill, in addition to a rear and a front mandrel thrust block comprises two feed clamping carriages, each with a feed chuck.

Consequently, the cold pilger rolling mill according to the invention is suitable for an efficient and cost-effective cold pilgering of long hollows with a length of 30 m or more.

In another embodiment of the present invention, each feed clamping carriage of the cold pilger rolling mill is designed to feed a hollow having a weight of 100 kg/m or more.

In an embodiment of the present invention, each feed clamping carriage is arranged to feed a hollow having a weight in a range between 100 kg/m and 150 kg/m.

In order to be able to feed in particular hollows with a length of at least 30 m and a weight per length between 100 kg/ and 150 kg/m with a feed clamping carriage, the feed clamping carriage in an embodiment comprises a correspondingly strong linear drive to feed the hollow towards the mandrel. In addition, the chuck also has a correspondingly strong rotational drive to rotate the hollow about its longitudinal axis.

In a further embodiment of the present invention, each feed clamping carriage of the cold pilger rolling mill is arranged to feed a hollow with a weight of 125 kg/m or more.

In an embodiment of the present invention, a coiling device is arranged in the feed direction of the hollow behind the rollers of the rolling mill, wherein the coiling device for the tube manufactured in the rolling mill comprises a bending device for bending the tube such that it can be coiled around a first axis, and a holding frame, wherein the bending device and the first axis are pivotably mounted on the holding frame about a second axis being substantially perpendicular to the first axis and substantially parallel to a longitudinal axis of a hollow received between the rollers.

Such a space-saving design also reduces the cost of long tubes considerably, since due to a coiling of long tubes by a coiling device one may dispense with very large and in particular very long workshops.

Such a coiling device also enables to pick up the readily worked tube from the cold pilger rolling mill and to bend it such that it can be coiled on a spiral path. This arrangement saves a considerable amount of time in the manufacturing of steel tubes which are dimensioned so that they can be coiled. The tube discharged from the roll stand can already be coiled while in the same strand still a hollow is fed into the pilger mouth and is worked between the rollers. In addition, the coiling device allows a considerable space saving for the cold pilger rolling mill as such, since in the manufacturing of the tube not the entire strand must be discharged over its entire length from the roll stand, before the tube can be coiled.

An essential aspect of the coiling device is that the bending device and the first axis are pivotally mounted about a second axis. In this way, the coiling device can follow a pivoting motion, which the tube or the hollow experiences during rolling driven by the feed clamping carriage, and the tube can be coiled without twisting. Without a corresponding pivotable mounting of the bending device and the first axis, there would be a twisting of the tube during coiling and an associated significant loss of quality of the finished tube.

The second axis, about which the bending device and the first axis are pivotably mounted on the holding frame, is parallel to the axis of symmetry of the finished tube leaving the roll stand. In an embodiment, the second axis coincides with the axis of symmetry of the finished tube leaving the roll stand.

In a further embodiment of the invention, the bending device and the first axis are driven by a motor and are pivotable about the second axis. Although the pivoting motion of the bending device can in principle also be effected by the swiveling motion of the finished tube leaving the roll stand, a motor drive largely prevents the tube from undergoing torsional stresses when it is coiled. A detailed description of embodiments of such a coiling device can be found in German patent application DE10,2009/045640 A1.

In a further embodiment of the present invention, the feed chuck of the feed clamping carriage is arranged to be pivotable by a motor and accepts the hollow pivotably about its longitudinal axis, and the cold pilger rolling mill also has a control which is arranged to pivot the feed chuck and the bending device as well as the first axis of the coiling device during operation of the coiling device synchronously at the same angular velocity. In such an embodiment, the bending device is pivotably mounted on the holding frame so that it can be pivoted about the second axis in a motor-driven manner. The "electronic drive shaft" between the feed clamping carriage and the coiling device allows almost torsion-free coiling of the finished tube.

In an embodiment of the present invention, the cold pilger rolling mill has an uncoiling device, by which a hollow coiled on a spindle about a first axis can be uncoiled and fed to the front mandrel thrust block for inserting into the cold pilger rolling mill.

In particular, hollows with a length of 30 m or more require a considerable amount of space when inserted into the cold pilger rolling mill lengthwise. By means of the uncoiling device according to the invention, a hollow previously coiled onto a spindle about a first axis and having a length of 30 m or more can be fed into the cold pilger rolling mill requiring substantially less space.

In an embodiment, the uncoiling device comprises a straightening device, which, during operation of the device, straightens the coiled, i.e. bent hollow. An example of such a straightening device is a straightening machine, in particular a rolling or skew rolling straightening machine. In this way, during uncoiling of the hollow, the hollow is straightened and at the same time loaded into the hollow bed between the front mandrel thrust block and the feed chuck or between the front and rear mandrel thrust block.

The uncoiling device according to the invention for the hollow thus ensures a more compact design of the overall layout of the cold pilger rolling mill, whereby the operating costs are further reduced. In an embodiment of the invention, the distance between the uncoiling device and the front end of the front mandrel thrust block is less than the distance between the rear end of the front mandrel thrust block and the front end of the feed chuck of the rear feed clamping carriage at the rear reversal point of the rear feed clamping carriage. In a further embodiment, the distance between the uncoiling device and the front end of the front mandrel thrust block is smaller than the distance between the rear end of the front mandrel thrust block and the front end of the rear mandrel thrust block.

In a further embodiment of the present invention, the cold pilger rolling mill has an annealing furnace, which is arranged to heat the hollow to a temperature in a range from 1000° C. to 1200° C. or in a range from 1050° C. to 1150° C. in operation of the cold pilger rolling mill.

In an embodiment, the annealing furnace is arranged in such a way that a hollow coiled on a spindle can be annealed in the annealing furnace. In an embodiment, therefore, the annealing furnace is a shaft furnace. In an alternative embodiment, the hollow is heated lengthwise in a continuous furnace to the temperatures listed above.

In a further embodiment of the present invention, the cold pilger rolling mill has a second cold pilger rolling mill for cold working a hollow such that a hollow in the second cold pilger rolling mill is workable into the hollow to be fed into an embodiment of the previously discussed cold pilger rolling mill, such that the tube discharged from the previously discussed cold pilger rolling mill is a tube rolled twice or more times.

In a further embodiment, each of the chucks of the individual mandrel thrust blocks comprises openings to insert clamping jaws in such a way that at least three clamping jaws of a mandrel thrust block engage the mandrel. This allows a simple, uncomplicated fixing of the mandrel bar by accessing the jaws, such that in operation of the cold pilger rolling mill at least one mandrel thrust block holds the mandrel bar while the jaws of the other mandrel thrust blocks can be opened to feed through a hollow.

In an embodiment, the chucks of the respective mandrel thrust blocks alternately hold the mandrel. Such alternate holding of the mandrel bar enables continuous operation of the cold pilger rolling mill so that one mandrel thrust block holds the mandrel bar while the other mandrel thrust block allows feeding of a hollow.

At least one of the above-mentioned problems of the prior art for rolling long hollows are also solved according to the present invention by a method for manufacturing a tube by cold working a hollow in a cold pilger rolling mill having a roll stand with rollers rotatably mounted thereon, a mandrel supported by a mandrel bar, at least one mandrel thrust block holding the mandrel bar and at least one feed clamping carriage having a feed chuck to receive the hollow, comprising the steps of:

a) opening in the radial direction a chuck of a front mandrel thrust block in the feed direction of the hollow and feeding a first hollow through the front mandrel thrust block,
b) after completely feeding the first hollow through the front mandrel thrust block, closing the chuck of the front mandrel thrust block in the radial direction such that the front mandrel thrust block holds the mandrel bar supporting the mandrel,
c) feeding the first hollow to the feed clamping carriage and receiving the first hollow by opening the feed chuck in the radial direction and clamping the first hollow by closing the feed chuck in the radial direction at a front reversal point of the feed chuck,
d) rolling the first hollow by the rollers over the mandrel into a strain-hardened tube by stepwise feeding the first hollow by means of the feed clamping carriage and oscillating the roll stand with the rollers back and forth between a front and a rear reversal point, wherein the first hollow has a length of 30 m or more.

Apart from the fact that the chuck of the mandrel thrust block can only be closed, when the hollow has completely passed through the chuck, the above numbering does not necessarily determine the order of the steps to be carried out. In particular, the feeding of the hollow to the feed clamping carriage already takes place when the chuck of the front mandrel thrust block is open.

The method according to the invention enables the machining of long hollows having a length of 30 m or more in a cold pilger rolling mill and consequently to work the hollow into a single piece strain-hardened tube having a length of at least 300 m. The finished tube has a very high quality due to the manufacturing process in a cold pilger rolling mill. This represents a significant improvement compared to the prior art since prior art cold pilger rolling mills can only roll hollows up to a maximum length of 16 m and consequently can only produce tubes of up to a certain length in a single piece.

An embodiment of the method according to the invention relates to a method for manufacturing a tube with the following additional step after step b) and before step c):

e) opening in a radial direction a chuck of a rear mandrel thrust block in a feed direction of the hollow, wherein the rear mandrel thrust block is positioned between the front reversal point of a front feed clamping carriage in the feed direction of the hollow and the front mandrel thrust block, wherein the rear mandrel thrust block has a distance of at least 30 m from the front mandrel thrust block, and feeding the first hollow through the rear mandrel thrust block, wherein the rolling of the first hollow by the rollers over the mandrel into a strain-hardened tube in step d) is carried out by stepwise feeding the first hollow alternately by means of the front feed clamping carriage from a front reversal point to a rear reversal point of the front feed clamping carriage and with the aid of a rear feed clamping carriage from a front reversal point to a rear reversal point of the rear feed clamping carriage and oscillatingly moving the roll stand with the rollers back and forth between a front and a rear reversal point;

and wherein the method further comprises the steps of:

f) after completely passing the first hollow through the rear mandrel thrust block, closing the chuck of the rear mandrel thrust block in the radial direction such that the rear mandrel thrust block holds the mandrel bar supporting the mandrel, g) during the rolling of the first hollow, opening the chuck of the front mandrel thrust block and passing a second hollow through the front mandrel thrust block into the area between the front mandrel thrust block and the rear mandrel thrust block, h) after completely passing the second hollow through the front mandrel thrust block, closing the chuck of the front mandrel thrust block such that the front mandrel thrust block holds the mandrel bar supporting the mandrel, i) opening the chuck of the rear mandrel thrust block, j) passing the second hollow through the rear mandrel thrust block, k) feeding the second hollow to the front feed clamping carriage and receiving the hollow in the feed chuck of the second feed clamping carriage and clamping the second hollow by closing the feed chuck of the second feed clamping carriage in the radial direction, l) opening the feed chuck of the rear feed clamping carriage in the radial direction, m) stepwise feeding the second hollow alternately with the aid of the front feed clamping carriage and the rear feed clamping carriage with the second hollow clamped, n) after completely discharging the finished tube rolled from the first hollow from the roll stand, inserting the second hollow into the roll stand, and o) rolling the second hollow by the rollers over the mandrel into a strain-hardened tube by stepwise feeding the second hollow alternately by means of the rear feed clamping carriage and the front feed clamping carriage and oscillatingly moving the roll stand with the rollers back and forth between a front and a back reversal point.

Such a method enables cold pilgering of long hollows, i.e. hollows of 30 meters or more, in a continuous operation to roll a first hollow while a second hollow is already fed into the cold pilger rolling mill. This is made possible in particular by the presence of two mandrel thrust blocks. A mandrel thrust block must always be closed in such a way that it holds the mandrel bar during rolling. In the case of two mandrel thrust blocks, one front and one rear mandrel thrust block, one mandrel thrust block holds the mandrel bar while the other mandrel thrust block is open to pass a second hollow though it. The operation of the cold pilger rolling mill is thus accelerated by the presence of at least two mandrel thrust blocks.

While the front and the rear feed clamping carriage alternately feed the second hollow in the direction towards the mandrel, the first hollow also receives a further feed in the direction towards the mandrel. The feed of the first hollow is effected indirectly by the alternating linear motion of the front and rear feed clamping carriage by the first hollow being pushed by the feed of the second hollow with the front and the rear feed clamping carriage.

A further embodiment of the present invention relates to a method for manufacturing a tube in which coiling of an already completely rolled section of the hollow is carried out simultaneously with rolling of a section of the hollow still to be rolled into a strain-hardened tube, comprising the steps of: bending an already completely rolled section of the hollow in a bending device, spirally coiling an already completely rolled section of the hollow about a first axis and pivoting the bending device received on a support frame and the first axis about a second axis which is substantially perpendicular to the first axis and substantially parallel to a longitudinal axis of a hollow received between the rollers such that the pivoting takes place at the same angular velocity as a pivoting of the hollow about its longitudinal axis during rolling of the hollow.

In the method of this type, the already rolled section of a hollow, i.e. the section of the already finished tube, is coiled around a first axis with the aid of a coiling device, while at the same time another section of the hollow is being rolled over the mandrel by the rollers rotatably mounted on the roll stand and possibly another section of the hollow is still fed in the direction towards the pilger mouth. The coiling in the coiling device takes place in such a way that the already finished tube is first bent in a bending device. As a result of the curvature, the tube is then spirally coiled around a first axis, wherein in addition to the coiling, the bending device and the first axis are pivoted about a second axis. The second axis extends substantially perpendicular to the first axis and parallel to a longitudinal axis of a hollow received between the rollers. In an embodiment, the second axis coincides with the longitudinal axis of the received hollow. In addition, the pivoting of the bending device and the first axis about the second axis occurs at the same angular velocity as a pivoting of the hollow about its longitudinal axis, so that twisting of the tube during coiling and an associated significant loss of quality is avoided in the finished tube.

An embodiment of the method according to the invention relates to uncoiling of a coiled hollow from a spindle of an uncoiling device so that the already uncoiled section of the hollow is passed through the front mandrel thrust block.

In an embodiment, when uncoiled, the hollow coiled on the spindle passes through bending rollers which straighten the hollow in the longitudinal direction again before the hollow passes through the front mandrel thrust block. The straightening of the hollow from its initial curved shape by the bending rollers takes place during the loading of the hollow in the cold pilger rolling mill, i.e. during the feeding of the hollow to the front mandrel thrust block and during the feeding of the hollow through the front mandrel thrust block.

Like the coiling deceive such a method saves a lot of space in the workshop in which the cold pilger rolling mill is placed, and consequently reduceds the manufacturing costs for the long tubes manufactured in the cold pilger rolling mill.

A further embodiment of the method according to the invention for manufacturing a tube is distinguished in that prior to the feeding of the hollow through the front mandrel thrust block, the hollow coiled on a spindle is heated to a temperature in a range from 1000° C. to 1200° C. In particular, in an embodiment of the method according to the invention, the hollow is heated to a temperature in a range of 1050° C. to 1150° C.

In a further embodiment of the method according to the invention, prior to the annealing of the hollow, another cold working of the hollow in a second cold pilger rolling mill takes place in such a way that the finished tube is manufactured by multiple cold working of a hollow. By a multiple cold working of a hollow, the tensile strength of the finished tube is further increased, so that the finished tube after repeated cold working a hollow has an increased load capacity.

Further advantages, features and applications of the present invention will become apparent from the following description of embodiments thereof and the accompanying drawings.

Figure 1:
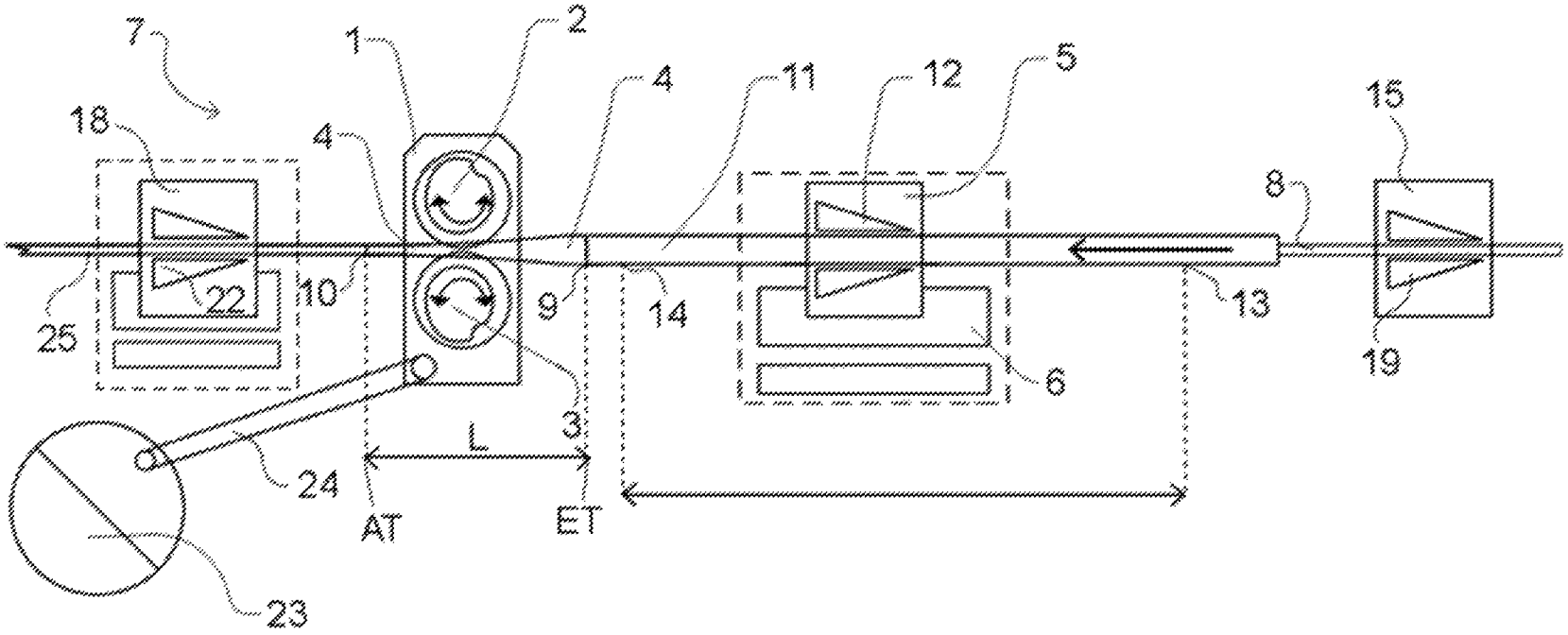
FIG. 1 shows a schematic side view of the layout of a cold pilger rolling mill with a front mandrel thrust block according to an embodiment of the present invention.

In FIG. 1, the layout of a cold pilger rolling mill according to the invention is shown schematically in a side view. The cold pilger rolling mill 7 consists of a roll stand 1 with an upper roller 2 and a lower roller 3, a calibrated mandrel 4 (in the figure, the position of the mandrel is denoted by reference number 4), a mandrel bar 8 supporting the mandrel 4, a feed clamping carriage 5 with a feed chuck 12 for receiving a hollow 11, a front mandrel thrust block 15 with a chuck 19 and a discharge clamping carriage 18 with a chuck 22. In the illustrated embodiment, the cold pilger rolling mill has a linear motor 6 as a direct drive for the feed clamping carriage 5.

During cold pilgering in the cold pilger rolling mill shown in FIG. 1, the hollow 11 experiences a stepwise feed in the direction towards the mandrel 4 or beyond the mandrel 4, while the rollers 2, 3 are rotationally moved back and forth in a horizontal direction over the mandrel 4 and thus over the hollow 11. The horizontal motion of the rollers 2, 3 is defined by the roll stand 1, on which the rollers 2, 3 are rotatably mounted. The roll stand 1 is reciprocated by means of a crank drive 23 via a push rod 24 in a direction parallel to the longitudinal axis of the hollow between a front reversal point 9 in the feed direction of the hollow 11 and a rear reversal point 10 in the feed direction of the hollow 11. The rollers 2, 3 in turn receive their rotational motion by a gear rack (not shown) being fixed with respect to the roll stand 1, wherein gear wheels (not shown) fixedly mounted on the roller axes comb with the gear rack. The feed of the hollow 11 over the mandrel 4 is carried out with the aid of the feed clamping carriage 5, which allows a translational motion in a direction parallel to the axis of the hollow 11. The feed clamping carriage 5 performs a reciprocating motion between a front reversal point 13 in the feed direction of the hollow 11 and a rear reversal point 14 in the feed direction of the hollow 11. In the embodiment of FIG. 1, the path of travel of the feed clamping carriage 5 between the two reversal points 13, 14 amounts to 24 m.

Once the hollow 11 has left the front mandrel thrust block 15, the chuck 19 of the front mandrel thrust block 15 is closed in the radial direction, so that the chuck 19 clamps the mandrel bar 8 firmly. In this case, the front mandrel thrust block 15 in FIG. 1 comprises a distance of 36 m from the feed chuck 12 of the feed clamping carriage 5, when the feed clamping carriage 5 is positioned at its rear reversal point 14. This distance is measured between the front end of chuck 19 of the front mandrel thrust block 15 and the front end of the feed chuck 12 of the feed clamping carriage 5 in the feed direction when the feed clamping carriage is at its rear reversal point 14. A hollow with a maximum length of 36 m could thus be arranged between the front mandrel thrust block 15 and the feed chuck 12 of the feed clamping carriage 5 positioned at its rear reversal point 14, without the hollow being pinched or clamped by the chuck 19 of the front mandrel thrust block 15 or the feed chuck 12 of the feed clamping carriage 5.

The mandrel bar 8 in FIG. 1 consists of the material 30 CrNiMo 8 and has a tensile strength of 1000 $N/mm^2$ and an elongation of 8%.

At the front reversal point 9 of the roll stand 1 in the feed direction of the hollow 11, i.e. at the inlet dead center ET of the roll stand, the hollow 11 enters between the rollers 2, 3 and is received by the infeed pockets (not shown) of the rollers 2, 3. The conically calibrated rollers 2, 3 stacked on top of each other in the roll stand 1 are rolled over the hollow 11 by rolling back and forth on the hollow 11 in the feed direction of the feed clamping carriage 5. The pair of rollers 2, 3 moves during a rolling stroke by a distance L from the inlet dead center ET to the rear reversal point 10 of the rolling stand in the feed direction of the hollow, i.e. to the discharge dead center AT of the roll stand. In FIG. 1 this corresponds to a rotation of the rollers by an angle of 280°. The pair of rollers 2, 3 stretches the hollow 11 over the mandrel 4 held in the interior of the hollow 11. The rollers 2, 3 and the mandrel 4 are calibrated such that the gap between the rollers 2, 3 and mandrel 4 in the working caliber zone of the rollers 2, 3 is steadily reduced from the wall thickness of the hollow 11 to the wall thickness of the finished rolled tube 25. In addition, the outer diameter defined by the rollers decreases from the outer diameter of the hollow 11 to the outer diameter of the finished tube 25 and the inner diameter defined by the mandrel 4 decreases from the inner diameter of the hollow 11 to the inner diameter of the finished tube 25. After the working caliber zone of the rollers 2, 3 follows the smoothing caliber zone of the rollers 2, 3, in which a smoothing of the surface of the tube 25 to be manufactured takes place. Upon reaching the rear reversal point 10 of the roll stand 1, the discharge pocket (not shown) of the rollers 2, 3 releases the finished rolled tube.

In order to obtain a uniform shape of the finished tube 25, the hollow 11 in addition to a stepwise feed experiences a rotation about its longitudinal axis. The rotation of the hollow 11 takes place at both reversal points 9, 10 of the roll stand 1, i.e. at the inlet dead center ET and at the discharge dead center AT. By repeatedly rolling over each tube section a uniform wall thickness and roundness of the tube and uniform inner and outer diameters are achieved.

The finished tube 25 is received by a chuck 22 of a discharge clamping carriage 18 and is pulled out of the cold pilger rolling mill 7.

Figure 2:
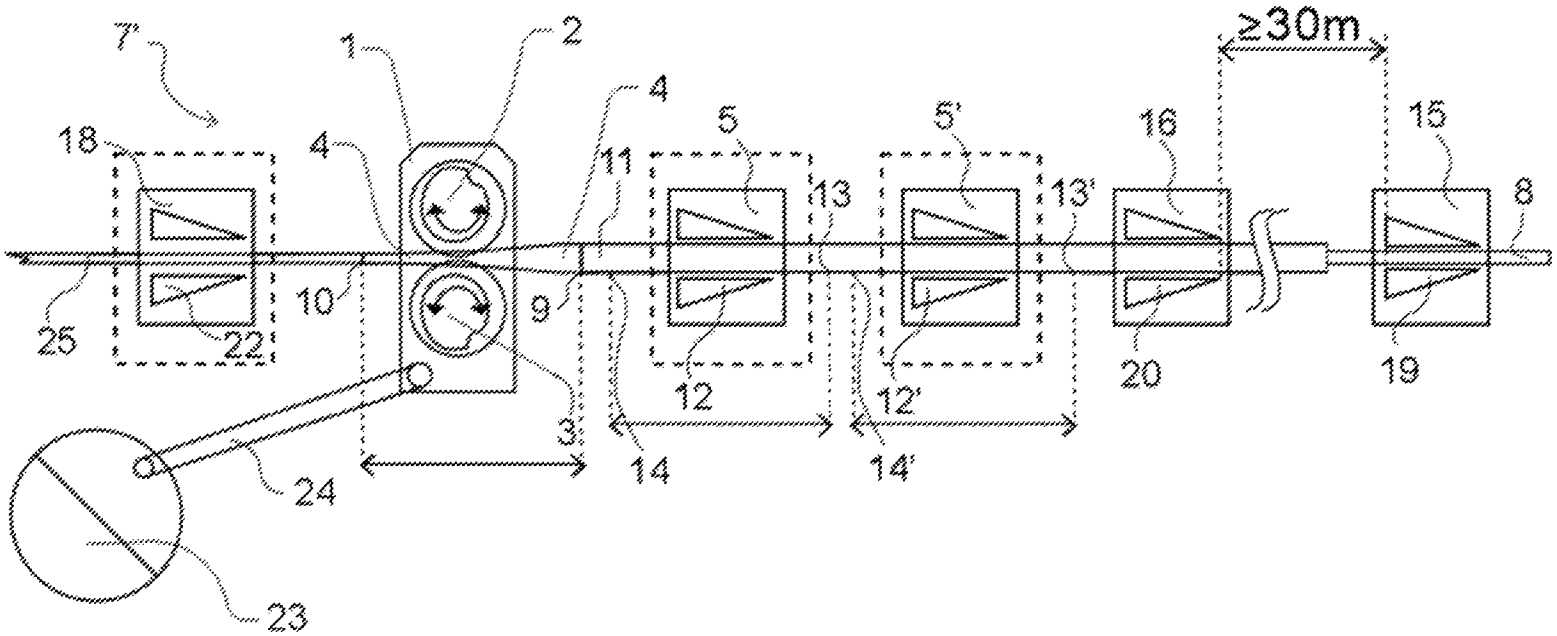
FIG. 2 shows a schematic side view of the layout of a cold pilger rolling mill with a front and a rear mandrel thrust block and two feed clamping carriages according to a further embodiment of the present invention.

FIG. 2 shows a schematic layout of another cold pilger rolling mill 7' according to the invention in a side view. In contrast to FIG. 1, however, the cold pilger rolling mill 7' illustrated in FIG. 2 has two feed clamping carriages 5, 5', each with a feed chuck 12, 12' to receive a hollow 11. The two feed clamping carriages 5, 5' can each be moved by 12 m between their front 13, 13' and rear reversal points 14, 14' and are therefore distinguished by a smaller path of travel in comparison with the feed clamping carriage 5 shown in FIG. 1.

The front feed clamping carriage 5' in the feed direction of the hollow 11 has already advanced the hollow towards its rear reversal point 14' in the direction towards the mandrel 4. The rear feed clamping carriage 5 in the feed direction of the hollow 11 approaches the front feed clamping carriage 5' in the feed direction of the hollow, so that the front feed clamping carriage 5', when it arrives at its rear reversal point 14', can pass over the hollow to the rear feed clamping carriage 5 at the front reversal point 13 of the rear feed clamping carriage 5. After the clamping of the hollow 11 by the rear feed clamping carriage 5, the rear feed clamping carriage 5 would in the next step feed the hollow 11 stepwise towards the mandrel 4, while the front feed clamping carriage 5' would return to its front reversal point 13' to receive another hollow 11'. In this way, a continuous operation of the cold pilger rolling mill is enabled, which avoids dead times during the return of a single feed clamping carriage 5 from its rear reversal point 14 to its front reversal point 13 as shown in FIGS. 1 and 2.

In contrast to the cold pilger rolling mill 7 shown in FIG. 1, the cold pilger rolling mill 7' of FIG. 2 in addition to the front mandrel thrust block 15, also has a rear mandrel thrust block 16 in the feed direction of the hollow 11. The rear mandrel thrust block 16 is arranged between the front reversal point 13' of the front feed clamping carriage 5' and the front mandrel thrust block 15 and, like the front mandrel thrust block 15, has a chuck 20 for holding the mandrel bar 8. The hollow 11 in FIG. 2 has left the front mandrel thrust block 15 already, so that the chuck 19 of the front mandrel thrust block 15 is closed and the mandrel 8 is firmly clamped. The chuck 20 of the rear mandrel thrust block 16, however, is opened and allows the hollow 11 to pass between the chuck 20 and the mandrel bar 8.

In FIG. 2, the distance between the front mandrel thrust block 15, measured at the rear end of the chuck 19 in the feed direction of the hollow, and the rear mandrel thrust block 16, measured at the front end of the chuck 20, amounts to 38 m, while the hollow 11 depicted in FIG. 2 has a length of 37 m. Accordingly, the hollow 11 can be arranged between the front 15 and rear mandrel thrust block 16 and the chucks 19, 20 of both mandrel thrust blocks 15, 16 can be closed without the chucks 19, 20 pinching the hollow 11.

Figure 3:
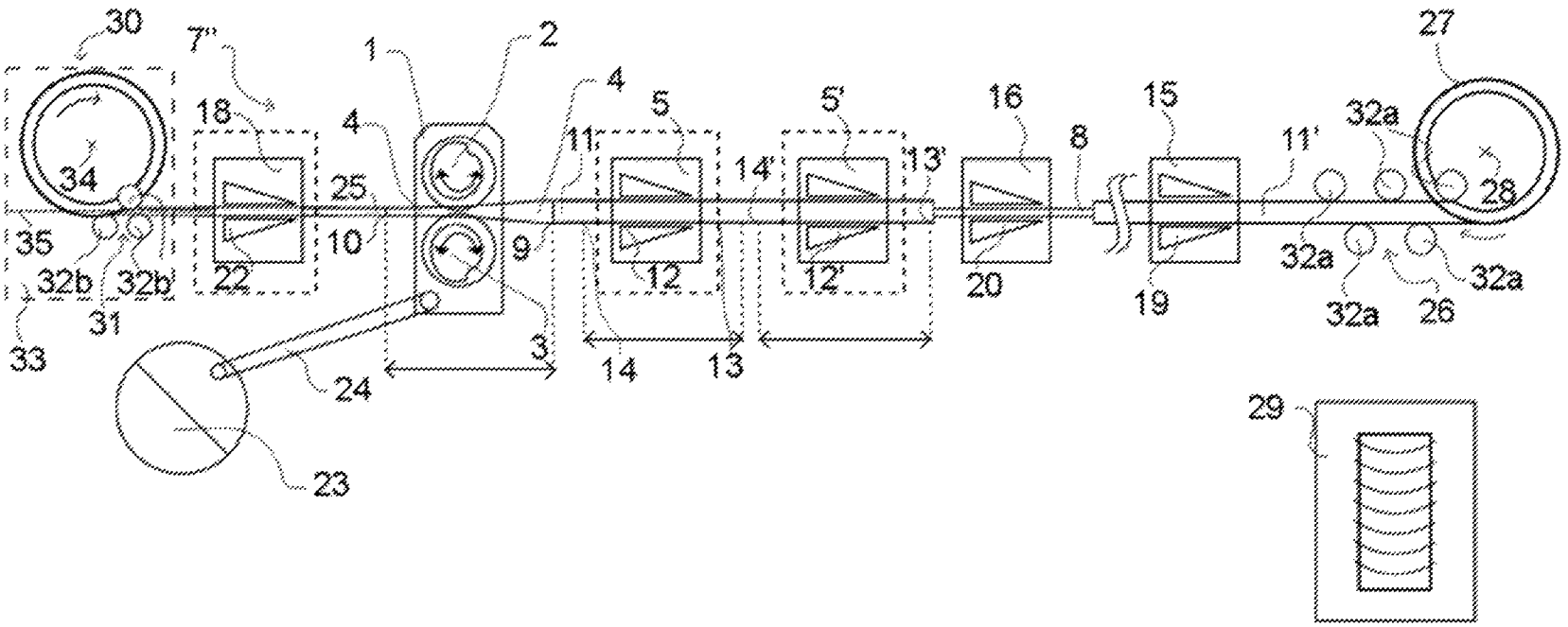
FIG. 3 shows a schematic side view of the layout of a cold pilger rolling mill with a front and a rear mandrel thrust block, two feed clamping carriages, an uncoiling device and a coiling device according to another embodiment of the present invention.

In FIG. 3, a cold pilger rolling mill 7" according to an embodiment of the invention is shown in a schematic side view, which in comparison to the cold pilger rolling mill 7' shown in FIG. 2 in addition to the two feed clamping carriages 5, 5', the front 15 and the rear mandrel thrust blocks 16 comprises an uncoiling device 26 and a coiling device 30.

The uncoiling device 26 ensures that a hollow 11 arranged on a spindle 27 and coiled around a first axis 28 is uncoiled. In this case, a motor-driven rotation of the spindle 27 occurs about the first axis 28 in the direction of the arrow depicted, so that the hollow arranged and coiled on the spindle 27 is fed between five bending rollers 32*a*. Three bending rollers 32*a* are arranged in an upper row and two bending rollers 32*a* are arranged in a lower row. The bending rollers 32*a* bend the hollow 11 passing uniformly and in opposite directions so that the hollow 11 is bent and straightened between the bending rollers 32*a* before being fed through the chuck 19 of the front mandrel thrust block 15. The straightening of the hollow 11 from its curved initial shape takes place during the loading of the hollow 11 through the front mandrel thrust block 15 in the cold pilger rolling 7".

The integration of an uncoiling device 26, as shown in FIG. 4, is particularly advantageous in case of hollows 5 having a length of 30 m or more. By uncoiling a coiled hollow 11 from the spindle 27 and simultaneously feeding the hollow 11 to the front mandrel thrust block 15 and passing the hollow 11 through the front mandrel thrust block 15, a lot of space can be saved in a workshop in which the cold pilger mill 7" is installed.

In order to be able to coil the finished tube 25 behind the roll stand 1 into a shape to be shipped, a coiling device 30 is additionally provided in the cold pilger rolling mill 7" shown in FIG. 3. The coiling device 30, which is shown schematically in FIG. 3, consists of a holding frame 33 and a bending device 31. The bending device 31 has three bending rollers 32*b*, which in the illustrated embodiment are all motor-driven and frictionally engaged with the finished tube 25.

The already completely rolled section of the hollow, i.e. the section of the already finished tube 25, is first received by a chuck 22 of a discharge clamping carriage 18 and is pulled in the direction towards the coiling device 30. As soon as a section of the already finished tube 25 runs between the bending rollers 32*b* of the bending device 31 of the coiling device 30, this section of the finished tube 25 is first bent by two bending rollers 32*b* arranged above the finished tube 25 and a bending roll 32*b* arranged below the finished tube 25. As a result of a motor-driven rotation of the coiling device 30 in the direction of the arrow depicted in FIG. 3, the curved portion of the finished tube 35 is coiled spirally around a first axis 34.

In addition, the bending device 31 and the three bending rollers 32*b* are pivotally mounted on the holding frame 33 about a second axis 35, which coincides with the longitudinal axis of the finished tube 25 leaving the discharge clamping carriage 18. In this case, the pivoting motion of the bending rollers 32*b* about the second axis 35 occurs by means of a motor drive. The pivoting occurring simultaneously with the coiling is carried at the same angular velocity as the pivoting motion of the hollow 11 about its longitudinal axis during the rolling of the hollow 11. Both pivoting motions therefore take place synchronously with respect to each other. This has the advantage that a twisting of the finished tube 25 during coiling is completely, but at least substantially, avoided and the finished tube 25 is coiled without any torsional stresses during rolling.

In addition, an annealing furnace 29 is provided in the same workshop in which the hollow 11 is annealed prior to entry into the pilger rolling mill 7" and after a first rolling in a second cold pilger rolling mill.

For purposes of the original disclosure, it is to be understood that all features as will become apparent to those skilled in the art from the present description, drawings, and claims, even though they have been specifically described in connection with certain further features, both individually and separately can be combined in any combination with others of the features or groups of features disclosed herein, unless this has been expressly excluded or technical conditions make such combinations impossible or pointless. For brevity and readability of the description a comprehensive, explicit representation of all conceivable combinations of features has been omitted. While the invention has been illustrated and described in detail in the drawings and in the foregoing description, such illustration and description is exemplary only and is not intended to limit the scope of protection as it is defined by the claims. The invention is not limited to the disclosed embodiments.

Variations of the disclosed embodiments will be apparent to those skilled in the art from the drawings, the description and the appended claims. In the claims, the word "comprising" does not exclude other elements or steps, and the indefinite article "a" or "an" does not exclude a plurality. The mere fact that certain features are claimed in different claims does not exclude their combination. Reference signs in the claims are not intended to limit the scope of protection.

LIST OF REFERENCE NUMBERS

1 roll stand
2, 3 upper, lower roller
4 mandrel
5 feed clamping carriage
6 linear motor
7, 7', 7" cold pilger rolling mill
8 mandrel bar
9 front reversal point of the roll stand
10 rear reversal point of the roll stand
12 feed chuck
13 front reversal point of the feed clamping carriage
14 rear reversal point of the feed clamping carriage
15 front mandrel thrust block
16 rear mandrel thrust block
18 discharge clamping carriage for finished tube
19, 20, 22 chuck
23 crankshaft
24 pushrod
25 finished tube
26 uncoiling device
27 spindle
28 first axis (uncoiling device)
29 annealing furnace
30 coiling device
31 bending device
32*a*, 32*b* bending roller
33 holding frame
34 first axis (coiling device)
35 second axis (coiling device)
ET inlet dead center
AT outlet dead center

The invention claimed is:

1. A cold pilger rolling mill for cold working a hollow into a tube comprising:

a roll stand comprising a plurality of rollers rotatably mounted on the roll stand, wherein the roll stand is driven by a motor and is movable back and forth in a direction parallel to a longitudinal axis of the hollow between a roll stand front reversal point and a roll stand rear reversal point, the roll stand front reversal point being in front of the roll stand rear reversal point in a feed direction of the hollow, and wherein, during a reciprocating motion of the hollow, the rollers perform a rotational motion, and wherein, in an operation of the cold pilger rolling mill, the rollers roll the hollow into the tube, a mandrel, wherein the mandrel is supported by a mandrel bar located, in the feed direction of the hollow, at a rear end of the mandrel bar so that during the operation of the cold pilger rolling mill the hollow is rolled by the rollers over the mandrel, a first feed clamping carriage with a feed chuck mounted thereon to receive the hollow, wherein the first feed clamping carriage is movable back and forth in a direction parallel to the longitudinal axis of the hollow between a first feed clamping carriage front reversal point and a first feed clamping carriage rear reversal point, the first feed clamping carriage front reversal point being in front of the first feed clamping carriage rear reversal point in the feed direction of the hollow, wherein, in the operation of the cold pilger rolling mill, the hollow experiences a stepwise feed in a direction towards the mandrel, and wherein the feed chuck of the first feed clamping carriage is openable and closeable in a radial direction to release or clamp the hollow, and at least one mandrel thrust block with a chuck mounted thereon to hold the mandrel bar, wherein the at least one mandrel thrust block includes a front mandrel thrust block with a front chuck, the front mandrel thrust block being positioned in front of the first feed clamping carriage in the feed direction of the hollow, wherein, in the operation of the cold pilger rolling mill, the mandrel bar is holdable by the front chuck of the front mandrel thrust block, and wherein the front chuck of the front mandrel thrust block is openable in a radial direction so that the hollow is feedable between the front chuck and the mandrel bar, wherein the front mandrel thrust block is at a distance of at least 30 m from the feed chuck of the first feed clamping carriage, measured with the first feed clamping carriage at the first feed clamping carriage rear reversal point.

2. The cold pilger rolling mill according to claim 1, wherein the mandrel bar has a tensile strength of 1000 $N/mm^2$ or more.

3. The cold pilger rolling mill according to claim 1, wherein the mandrel bar has an elongation of 10% or less.

4. The cold pilger rolling mill according to claim 1, wherein the cold pilger rolling mill further comprises:

a second feed clamping carriage with a feed chuck mounted thereon, and a controller, wherein the second feed clamping carriage is movable back and forth in the direction parallel to the longitudinal axis of the hollow between a second feed clamping carriage front reversal point and a second feed clamping carriage rear reversal point, the second feed clamping carriage front reversal point being in front of the second feed clamping carriage rear reversal point in the feed direction of the hollow, wherein the first feed clamping carriage, relative to the feed direction of the hollow, is in front of the second feed clamping carriage, wherein the controller is configured to control a back and forth movement of the first and second feed clamping carriages, wherein the cold pilger rolling mill, in a continuous operation, is capable of alternatively clamping each of a plurality of hollows, in addition to the hollow, by one of the feed chucks, and wherein the feed chucks are capable of stepwise feeding in the feed direction towards the mandrel.

5. The cold pilger rolling mill according to claim 1, wherein the at least one mandrel thrust block further comprises a rear mandrel thrust block with a chuck for mounting the mandrel bar, wherein the rear mandrel thrust block is, in the feed direction of the hollow, positioned between the first feed clamping carriage front reversal point of the first feed clamping carriage and the front mandrel thrust block, wherein the rear mandrel thrust block is at a distance of at least 30 m from the front mandrel thrust block, and wherein, during the operation of the cold pilger rolling mill, the mandrel bar is mountable by at least one chuck of the front mandrel thrust block or of the rear mandrel thrust block.

6. The cold pilger rolling mill according to claim 1, wherein the first feed clamping carriage of the cold pilger rolling mill is configured to feed the hollow with a weight of 100 kg/m or more.

7. The cold pilger rolling mill, according to claim 1, further comprising a coiling device that is arranged, in the feed direction of the hollow, behind the rollers of the cold pilger rolling mill, wherein the coiling device-comprises a holding frame and a bending device to bend the tube so that the tube can be coiled around a first axis, wherein the bending device and the first axis are pivotably received on the holding frame around a second axis, and wherein the second axis is perpendicular to the first axis and parallel to the longitudinal axis of the hollow received between the rollers.

8. The cold pilger rolling mill, according to claim 1, further comprising an uncoiling device having a spindle, wherein the hollow is coilable on the spindle of the uncoiling device by rotating the spindle about a first.

9. The cold pilger rolling mill, according to claim 8, further comprising an annealing furnace, wherein the annealing furnace is configured to heat the hollow when in a coiled state on the spindle of the uncoiling device to a temperature in a range from 1000° C. to 1200° C.

10. The cold pilger rolling mill, according to claim 1, further comprising an annealing furnace, wherein the annealing furnace is configured to heat the hollow to a temperature in a range from 1000° C. to 1200° C.

11. A method for manufacturing a tube in a cold pilger rolling mill with a roll stand having rollers rotatably mounted thereon, a mandrel supported by a mandrel bar, at least a front mandrel thrust block holding the mandrel bar, and at least a first feed clamping carriage with a feed chuck, the method comprising the steps of:

a) opening a chuck of the front mandrel thrust block in a radial direction and feeding a first hollow through the front mandrel thrust block, b) after completely feeding the first hollow through the front mandrel thrust block, closing the chuck of the front mandrel thrust block in the radial direction such that the front mandrel thrust block holds the mandrel bar supporting the mandrel, c) feeding the first hollow to the first feed clamping carriage and receiving the first hollow by opening the feed chuck in the radial direction and clamping the first hollow by closing the feed chuck in the radial direction, wherein the feed clamping carriage is at a first feed clamping carriage front reversal point, d) rolling the first hollow by the rollers over the mandrel into the tube by a first hollow rolling process that includes stepwise feeding of the first hollow by means of the first feed clamping carriage, and an oscillating motion of the roll stand with the rollers, wherein the oscillating motion of the roll stand with the rollers moves the roll stand back and forth between a roll stand front reversal point and a roll stand rear reversal point, wherein the front mandrel thrust block is at a distance of at least 30 m from the feed chuck of the first feed clamping carriage, measured with the first feed clamping carriage at a first feed clamping carriage rear reversal point, and wherein the first hollow has a length of 30 m or more.

12. The method for manufacturing a tube according to claim 11, wherein the cold pilger rolling mill includes a rear mandrel thrust block with a rear chuck and a second feed clamping carriage with a second feed chuck, the first feed clamping carriage positioned in front of the second feed clamping carriage, relative to a feed direction of the first hollow, and the method further comprises an additional step after step b) and before step c) of:

e) opening a chuck of the rear mandrel thrust block in the radial direction, wherein the rear mandrel thrust block is positioned between the first feed clamping carriage front reversal point and the front mandrel thrust block, wherein the rear mandrel thrust block is at a distance of at least 30 m from the front mandrel thrust block, and feeding the first hollow through the rear mandrel thrust block, wherein rolling the first hollow by the rollers over the mandrel into the tube in step d) occurs by stepwise feeding the first hollow alternately by the first feed clamping carriage moving from the first feed clamping carriage front reversal point to the first feed clamping carriage rear reversal point and by the second feed clamping carriage moving from a second feed clamping carriage front reversal point to a second feed clamping carriage rear reversal point and oscillating the roll stand with the rollers back and forth between the roll stand front reversal point and the roll stand rear reversal point, and the method further comprises the steps of:

f) after completely feeding the first hollow through the rear mandrel thrust block, closing the chuck of the rear mandrel thrust block in the radial direction so that the rear mandrel thrust block holds the mandrel bar supporting the mandrel, g) during rolling of the first hollow, opening the chuck of the front mandrel thrust block and feeding a second hollow through the front mandrel thrust block into an area between the front mandrel thrust block and the rear mandrel thrust block, h) after the second hollow has been fed completely through the front mandrel thrust block, closing the chuck of the front mandrel thrust block so that the front mandrel thrust block holds the mandrel bar supporting the mandrel, i) opening the chuck of the rear mandrel thrust block, j) feeding the second hollow through the rear mandrel thrust block, k) feeding the second hollow to the first feed clamping carriage and receiving the second hollow in the feed chuck of the first feed clamping carriage and clamping the second hollow by closing the feed chuck of the first feed clamping carriage in the radial direction, l) opening the feed chuck of the second feed clamping carriage in the radial direction, m) stepwise feeding the second hollow alternately by means of the first feed clamping carriage and the second feed clamping carriage with the second hollow being clamped, n) completely discharging the tube rolled of the first hollow from the roll stand and, thereafter, inserting the second hollow into the roll stand, and o) rolling the second hollow by the rollers over the mandrel into a tube by a second hollow rolling process that includes stepwise feeding the second hollow alternately using the second feed clamping carriage and the first feed clamping carriage and the oscillating motion of the roll stand with the rollers.

13. The method for manufacturing a tube according to claim 11, further comprising the steps:

bending a first part of the first hollow in a bending device, wherein the first part of the first hollow is already completely milled, wherein the bending device includes a plurality of bending rollers, and wherein the plurality of bending rollers are pivotably mounted on a holding frame around a second axis that coincides with a longitudinal axis of the first part of the first hollow as the first part of the first hollow exits a discharge clamping carriage, spirally coiling the first part of the first hollow about a first axis of a winding device, and pivoting the bending device about a second axis, wherein the second axis is substantially perpendicular to the first axis and the second axis is substantially parallel to a longitudinal axis of the first hollow received between the rollers o the roll stand, and wherein pivoting the bending device about the second axis occurs at a first angular velocity and pivoting of the first hollow about the longitudinal axis of the first hollow during the rolling of the first hollow occurs at a second angular velocity, the first angular velocity being the same as the second angular velocity.

14. The method for manufacturing a tube according to claim 11, wherein the cold pilger rolling mill further comprises an uncoiling device having a spindle, and wherein the method further comprises, prior to the opening of the feed chuck of the second feed clamping carriage, uncoiling the first hollow from the spindle, wherein the uncoiling results in an uncoiled section of the first hollow being fed through the front mandrel thrust block.

15. The method for manufacturing a tube according to claim 14, further comprising heating the first hollow to a temperature in a range from 1000° C. to 1200° C. prior to the uncoiling.

16. The method for manufacturing a tube according to claim 14, further comprising, prior to feeding the uncoiled section of the first hollow through the front mandrel thrust block, the following:

(i) cold working the first hollow in a second cold pilger rolling mill, and (ii) heating the first hollow discharged from the second cold pilger rolling mill to a temperature in a range from 1000° C. to 1200° C.

* * * * *